US005254973A

United States Patent [19]

Gilmore, II

[11] Patent Number: 5,254,973

[45] Date of Patent: Oct. 19, 1993

[54] SECURITY CIRCUIT AND MODULAR DEVICES THEREFOR

[76] Inventor: John H. Gilmore, II, 627 Bakewell La., Naperville, Ill. 60565

[21] Appl. No.: 843,179

[22] Filed: Feb. 28, 1992

[51] Int. Cl.[5] ..... G08B 13/08

[52] U.S. Cl. ..... 340/547; 340/533; 340/546; 340/693; 439/344

[58] Field of Search ..... 340/547, 546, 693, 533; 439/344

[56] References Cited

U.S. PATENT DOCUMENTS

| | | | |
|---|---|---|---|
| 3,696,380 | 10/1972 | Murphy | 340/546 |
| 4,117,465 | 9/1978 | Timblin | 340/545 |
| 4,319,228 | 3/1982 | Daniels | 340/546 |
| 4,493,951 | 1/1985 | Sanderson et al. | 379/28 |
| 4,654,640 | 3/1987 | Carll et al. | 340/568 |
| 4,703,989 | 11/1987 | Price et al. | 439/344 |
| 4,740,172 | 4/1988 | Tubbs | 439/344 |
| 4,742,336 | 5/1988 | Hall et al. | 340/539 |
| 4,807,255 | 2/1989 | Idland | 340/538 |
| 4,943,799 | 7/1990 | Papineau | 340/521 |
| 5,103,206 | 4/1992 | Yu | 340/533 |
| 5,130,695 | 7/1992 | Scarbrough et al. | 340/547 |

*Primary Examiner*—Glen R. Swann, III

*Attorney, Agent, or Firm*—Emrich & Dithmar

[57] ABSTRACT

A security circuit includes a power supply and one or more modular switch units and a modular alarm unit. Each modular unit includes two standard multiple-conductor telephone jack sockets, with at least one conductor of each socket connected to the circuitry of the unit, with all of the other conductors of one socket being respectively directly connected in-line to the corresponding conductors of the other socket. The modular units are interconnectable with standard telephone connector cables having modular telephone jack plugs mateable with the sockets. The power supply may be a battery which may also be provided with modular telephone jack sockets. Alternatively, the circuit may be powered from the RS-232 serial port of a personal computer, the telephone connector cable being coupled thereto through a standard adapter. Different versions of switch units and alarm units are disclosed. Series circuits are terminated with a spiral terminator plug.

20 Claims, 3 Drawing Sheets

SECURITY CIRCUIT AND MODULAR DEVICES THEREFOR

BACKGROUND OF THE INVENTION

1. Field of the Invention

The present invention relates to security circuits of the type used to monitor access points to a building or the like.

2. Description of the Prior Art

Security circuits for protecting various types of premises are well known. Some circuits typically include a power source, one or more sensing devices to sense an alarm condition and an alarm annunciator to signal the alarm condition, along with electrical conductors to interconnect the various elements of the circuit. The sensing devices may be any of various types, including thermal, acoustic, optical and mechanical, and the alarm annunciator may also be any of a number of types which produce audible, tactile and/or visible alarm signals. The various components of the alarm system are typically interconnected by standard insulated electrical conductors, and installation of the system typically requires a considerable amount of hand wiring, including stripping the insulation from conductor ends and attaching the conductor wires to device terminals, as by soldering or by the use of various types of wire connectors. Thus, the installation of a security system normally must be accomplished by a professional electrician, or a non-professional who has some basic electrical skills and the necessary tools.

SUMMARY OF THE INVENTION

It is a general object of the invention to provide an improved security circuit and devices therefor which avoid the disadvantages of prior security circuits while affording additional structural and operating advantages.

An important feature of the invention is the provision of a modular device which can be interconnected in circuit with other devices in a simple and economical manner by an unskilled person.

In connection with the foregoing feature, another feature of the invention is the provision of a device of the type set forth, which can be interconnected in circuit with other devices without the use of tools.

Still another feature of the invention is the provision of a device of the type set forth which is modular and can be interconnected with other devices by the means of standard jack connectors which are readily obtainable at retail outlets by non-professional personnel.

Another feature of the invention is the provision of a security circuit comprising a number of the modular devices of the type set forth, interconnected by standard jack connectors.

Still another feature of the invention is the provision of a security circuit of the type set forth, which can include plural, independently controlled zones.

These and other features of the invention are attained by providing a modular device for interconnection with other devices by means of standard multiple conductor telephone connector cables each having ends terminated respectively by modular telephone jack plugs, the modular device comprising: an insulated housing including a function portion and a modular jack portion, a function circuit disposed in the function portion, and two standard telephone jack sockets disposed in the jack portion and each having a plurality of conductors, at least one conductor of one of the sockets and a corresponding at least one conductor of the other of the sockets being connected to the function circuit, the remaining conductors of the one socket being respectively directly connected to the corresponding conductors of the other socket.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figure 1:
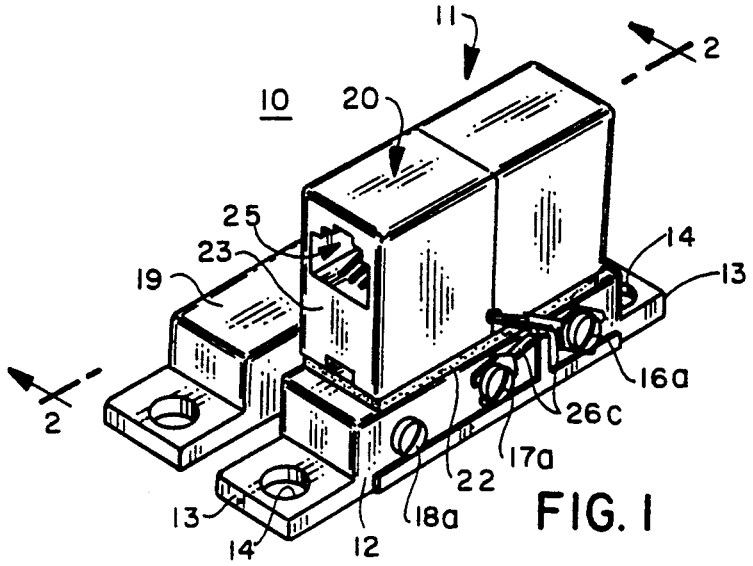
FIG. 1 is a perspective view of a modular switch constructed in accordance with and embodying the features of the present invention.

Referring to FIGS. and 2, there is illustrated a modular switch unit, generally designated by the numeral 10, constructed in accordance with the present invention. The switch unit 10 has a housing 11 which includes a function or switch portion 12 which is generally in the shape of a rectangular box and is provided at the opposite ends thereof with outwardly extending mounting tabs 13, each provided with a hole 14 therethrough for receiving an associated fastener (not shown), such as a screw or the like, for securing the housing 11 to an associated support surface. Disposed in the switch portion 12 of the housing 11 is a magnetically operated reed switch 15, which includes a fixed contact 16 and a pair of movable contacts 17 and 18, these contacts being respectively provided with terminals 16*a*–18*a*, which are illustrated as being standard screw post terminals and extend outside the housing portion 12. The switch unit 10 also includes a magnet portion 19 which includes a box-like housing substantially identical to the switch portion 12 and containing therein a suitable permanent magnet (not shown).

Figure 3A:
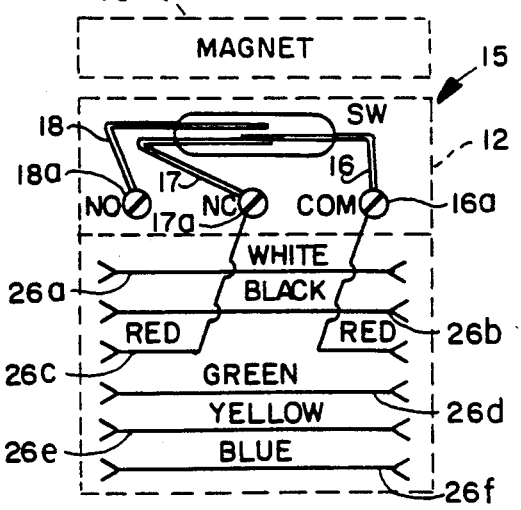
FIG. 3A is a schematic diagram of the modular switch FIGS. 1 and 2.
Figure 4:
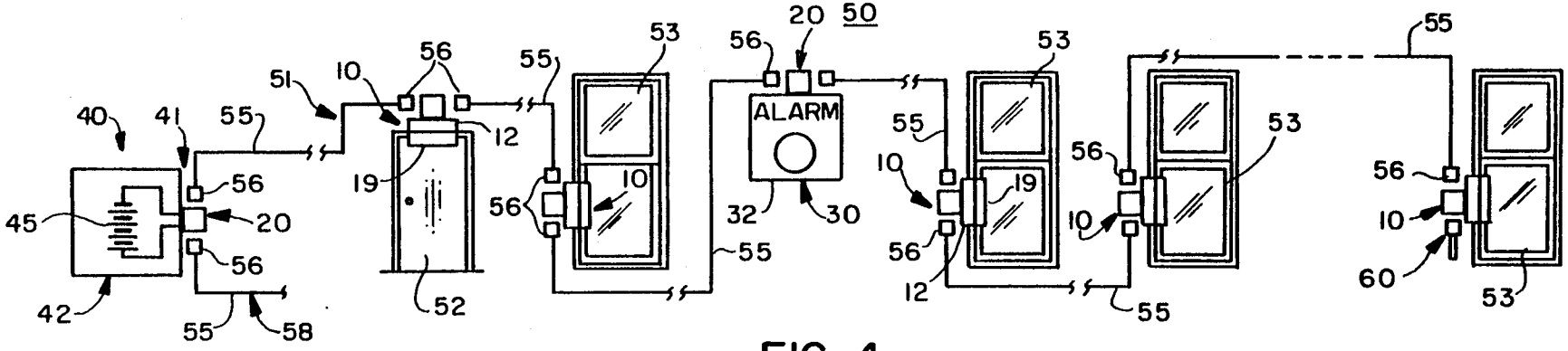
FIG. 4 is a partially schematic and partially block diagram of a security circuit in accordance with a first embodiment of the present invention.
Figure 5:
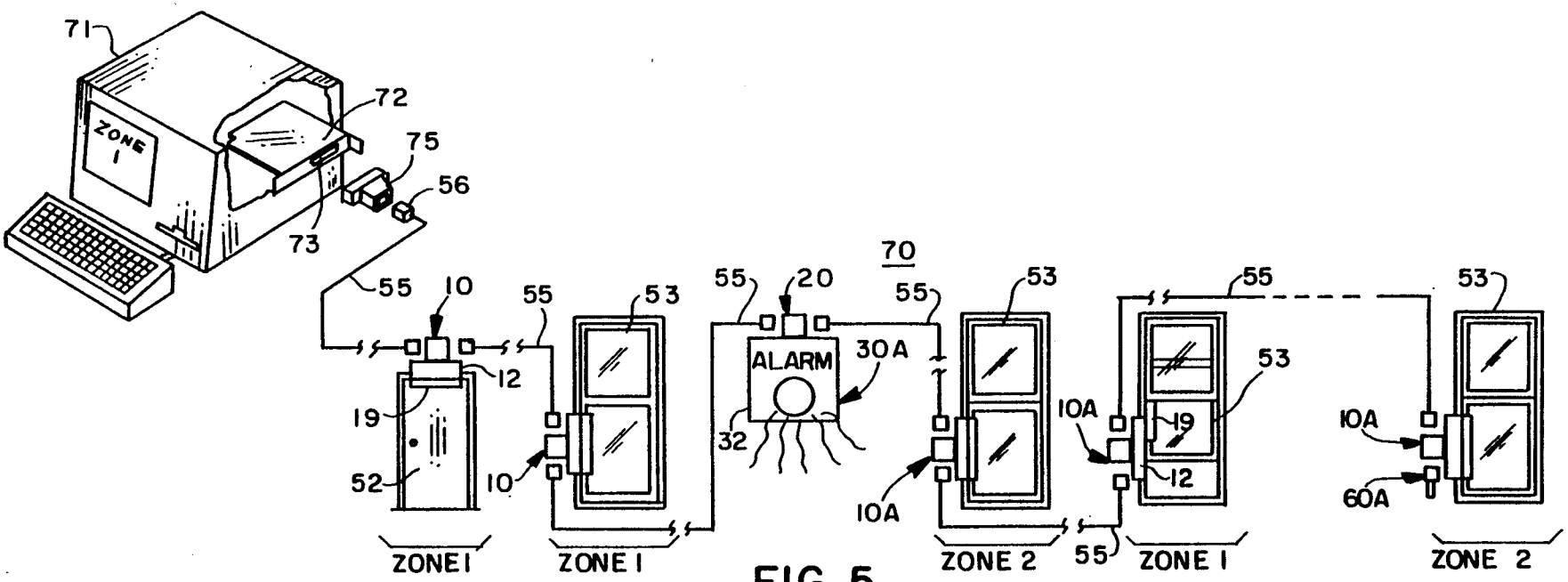
FIG. 5 is a view similar to FIG. 4 of another embodiment of security circuit in accordance with the present invention.

The reed switch 15 is of standard construction and, in use, it will be appreciated that the switch portion and the magnet portion 12 and 19 of the housing 11 are respectively mountable adjacent to each other on fixed and movable portions of an access opening closure, such as a door or window, as illustrated, for example, in FIGS. 4 and 5. Referring to FIG. 3A, it can be seen that the reed switch 15 has the movable contacts 17 and 18 thereof, respectively disposed on opposite sides of the fixed contact 16, so that the switch 15 can be connected in either a normally-closed or a normally-open configuration. In the normally-open configuration, illustrated in FIG. 3A, the conductors of the associated security circuit are connected to the terminals 16*a* and 17*a*. In this configuration, when the magnet portion 19 of the housing is disposed closely adjacent to the switch portion 12, it holds the reed switch 15 closed, and when the housing portions are separated, as when someone opens the door or window to which they are connected, the switch contact 17 will move to an open condition. It can be seen that simultaneously, the switch contact 18 will move to a closed condition so that, if the circuit conductors had been connected to the terminal 18*a* instead of the terminal 17*a* the reed switch 15 would be connected in a normally open configuration.

The housing 11 also includes a jack portion 20 which is generally box-like in shape and has a bottom wall 21 fixedly secured to the top wall of the switch portion 12 by any suitable means, such as by a double-sided adhesive tape 22. While the housing 11 is illustrated with discrete switch and jack portions 12 and 20 interconnected with each other, it will be appreciated that they could also be provided in a unitary, one-piece molded construction. The jack portion 20 has opposed end walls 23 in which are respectively formed standard telephone-type jack sockets 25 and 25A which are substantially mirror images of each other.

Figure 2:
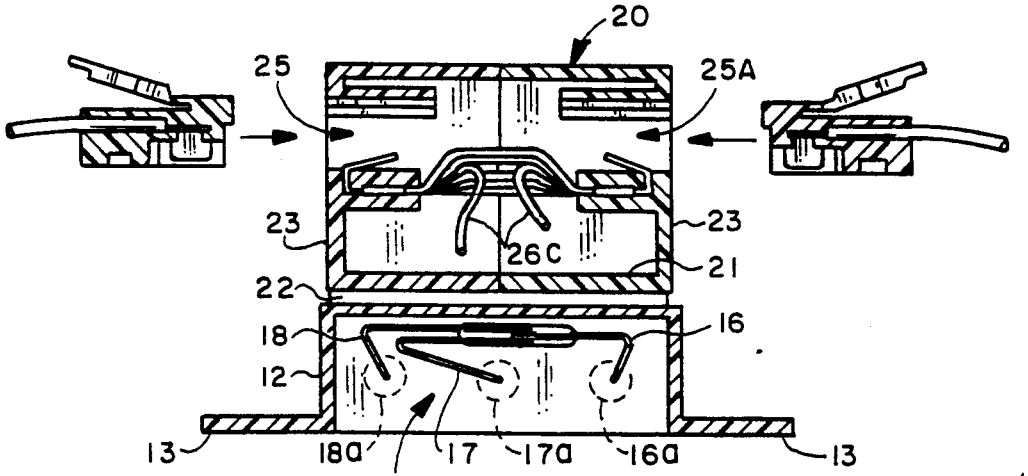
FIG. 2 is a view in vertical section taken along the line 2—2 in FIG. 2.

The jack portion 20 has a plurality of conductors, the illustrated embodiment having six such conductors 26*a*–26*f*, with each conductor having the opposite ends thereof respectively terminated at spring contacts in the jack sockets 25 and 25A. The conductors are typically color coded, the colors in the illustrated embodiment, respectively being white, black, red, green, yellow and blue. One of these conductors, e.g., the red conductor 26*c* in the embodiment illustrated in FIGS. 1 and 2, is cut and has the ends thereof passed out through a suitable opening in the jack portion 20 of the housing 11 and respectively coupled, as by spade connectors, to two of the switch terminals on the switch portion 12. More specifically, one end of the conductor 26*c* is connected to the common terminal 16*a* and the other end thereof is connected to one or another of the terminals 17*a* and 18*a*, depending upon whether the switch is to be arranged in a normally closed or normally open condition.

Figure 3B:
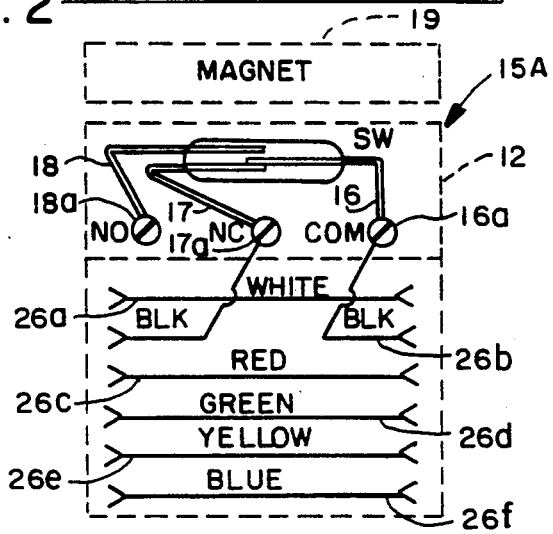
FIG. 3B is a view similar to FIG. 3A showing a modular switch in accordance with the present invention, with the conductors thereof arranged in a different configuration.

It is a significant aspect of the invention that, since the conductor which is connected to the terminals of the reed switch 15 is passed outside the jack portion 20 of the housing 11, its color is visible to a user. While in FIGS. 1 and 2, the red conductor 26*c* is connected to the reed switch 15, it will be appreciated that any color conductor could be so connected. Thus, for example, in FIG. 3B there is illustrated another configuration of switch unit, designated 10A, in which the black conductor 26*b* is connected to the switch terminals. Thus, it can be seen that the modular switch unit can be provided in different versions, respectively having different colored conductors connected to the reed switch 15. This facilitates connection of the switch unit in different zones of a security circuit, as will be explained in greater detail below.

While, in the illustrated embodiments, the alarm sensing device is shown as being a reed switch, it will be appreciated that the principles of the present invention could be applied to other types of sensing devices by simply adding thereto the jack portion 20 of the modular switch unit 10 and connecting one of more of the conductors of the sockets 25 and 25A with the sensing device.

Figure 6A:
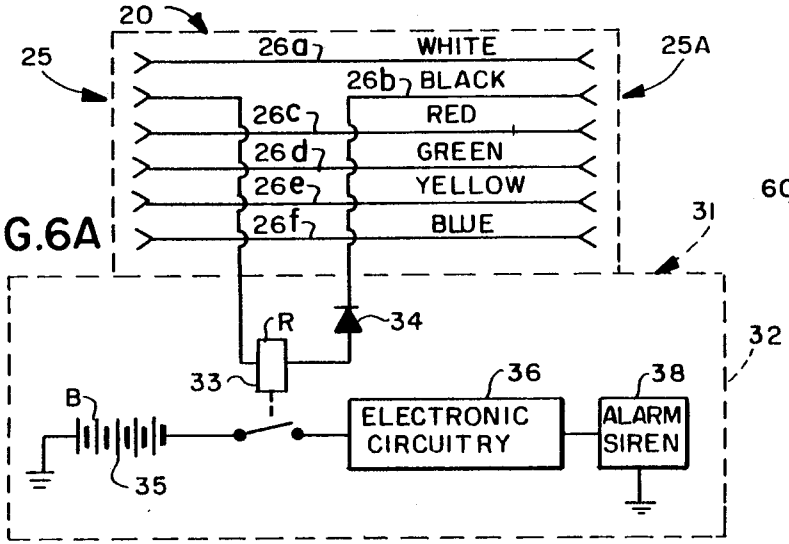
FIG. 6A is a partially schematic and partially block circuit diagram of the modular alarm annunciator used in the circuit of FIG. 4.

Referring also to FIGS. 6A, there is illustrated a modular alarm unit, generally designated by the numeral 30, in accordance with the present invention. The alarm unit 30 has a housing 31 which includes a function or alarm portion 32 and a jack portion 20 which is substantially identical to the jack portion 20 described above in connection with the modular switch unit 10. The alarm portion 12 includes suitable alarm circuitry, which may include a relay 33 connected through a diode 34 in series with one of the conductors of the sockets 25 and 25A in the jack portion 20. The alarm circuitry also includes a battery 35 connected through the contacts of the relay 33 to suitable electronic control circuitry 36 and a suitable alarm siren 38. While an audible alarm annunciator is illustrated, it will be appreciated that other types of alarm devices could also be provided in the alarm portion 32.

Figure 6B:
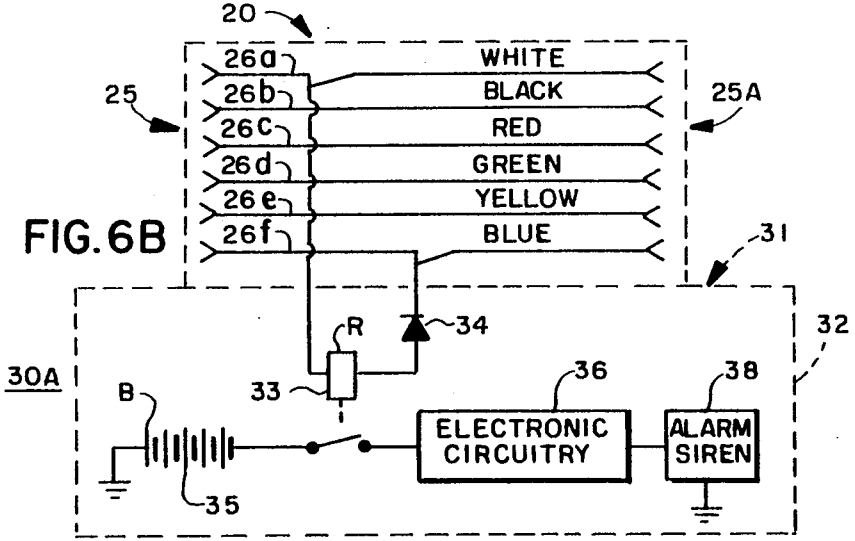
FIG. 6B is a partially schematic and partially block diagram of the modular alarm annunciator used in the circuit of FIG. 5.

In FIG. 6B, there is illustrated a modified form of modular alarm unit, designated 30A, which is substantially the same as the alarm unit illustrated in FIG. 6A, except that the alarm circuitry instead of being connected in series with one of the sockets conductors is connected across two of the socket conductors. More specifically, in the illustrated embodiment, the alarm circuitry and, in particular, the relay 33 thereof is connected across the white and blue conductors 26*a* and 26*e* of the sockets 25 and 25A.

Preferably, in both of the alarm units 30 and 30A, the socket conductors connected to the alarm circuitry will be passed outside the housing 31 so as to be visible by a user. It will be appreciated that still other alarm connection configurations could be utilized, depending upon the nature of the security circuit in which the modular alarm unit is to be used.

Referring to FIG. 4 there is also illustrated a modular battery unit 40 which includes a housing 41 having a function or battery portion 42 in which is disposed a battery 45. The housing 41 also includes the jack portion 20 connected thereto, the terminals of the battery 45 being connected across one or more pairs of the conductors of the sockets 25 and 25A of the jack portion 20.

In FIG. 4, there is illustrated a security circuit, generally designated by the numeral 50, which incorporates some of the modular devices described above. More specifically, the security circuit 50 includes a zone 51 which is designed to monitor the condition of a door 52 and a number of windows 53, each provided with one of the modular switch units 10. Preferably, the magnet portion 19 of the modular switch unit 10 is mounted on the movable member, such as the door itself or the movable pane of a window, while the switch portion 12 of the switch unit 10 is mounted on a fixed surface, such as the door jamb or the window frame.

It is a significant aspect of the present invention that, once the modular switch units 10 are mounted in place, they may readily be interconnected by standard telephone jack cables 55, each being a six-conductor cable of a predetermined length provided at the opposite ends thereof with telephone jack plugs 56, each having a resilient latch tab 57 (see FIG. 2), all in standard fashion. It will be appreciated that the cables 55 may be obtained in retail outlets in varying lengths. In the illustrated embodiment, the switch units 10 are all interconnected in a series circuit with a suitable power supply, such as the modular battery unit 40, and a modular alarm unit 30. Thus, for example, the modular switch units 10 may all be the versions illustrated in FIG. 3A, with the red conductors 26*c* connected to the reed switches 15. In this case, the modular battery unit 40 would have the battery terminals connected across the red and green conductors 26*c* and 26*d*, for example, of the sockets of the jack portion 20. Thus, the modular battery unit 40 would be connected to the nearest one of the modular switch units 10 by one of the cables 55. In like manner, it will be appreciated that the modular alarm unit 30 will be connected to one or more of the switch units 10 with the cables 55.

In this series configuration, the switch units 10 and the alarm unit 30 are all connected to the red conductor, the user having selected only red conductor switch units 10 and alarm unit 30 for this circuit zone 51. It will be appreciated that, if desired, the security circuit could be provided with another zone 58 plugged into the other socket of the jack portion 20 of the modular battery unit 40. In this case, the battery terminals could also be connected across another pair of the socket conductors, for example across the black and yellow conductors. No circuit elements have been illustrated in the zone 58 but it would be appreciated that it could be a collection of elements similar to those illustrated in the zone 51. However, in this case the user would select all switch units 10A, for example, and a corresponding variant of the alarm unit 30, all having the black conductor exposed, so as to distinguish zones 51 and 58 from each other.

Figure 8:
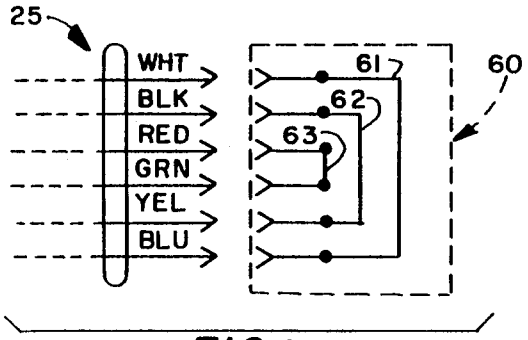
FIG. 8 is a schematic diagram of the terminating plug of FIG. 7.
Figure 7:
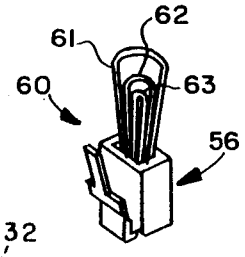
FIG. 7 is a perspective view of a terminating plug in accordance with the present invention.

In a series-connected zone, such as the zone 51, in order to close the circuit loop, the green conductor of the last unit in the zone 51 must be connected to the modular battery unit 40. For this purpose there is provided a termination plug 60, illustrated in FIGS. 7 and 8. The plug 60 is a standard telephone jack plug 56 of the same type which is used with the cables 55, except that it is provided with one or more jumper wires 61 for interconnecting selected ones of the plug conductors. In the illustrated embodiment, there are three jumper wires 61, 62 and 63, the jumper wire 61 interconnecting the white and blue conductors, the jumper wire 62 interconnecting the black and yellow conductors and the jumper wire 63 interconnecting the red and green conductors. Thus, it will be appreciated that when the termination plug 60 is plugged into the open socket in the jack portion 20 of the last modular switch unit 10 (furthest from the modular battery unit 40), the jumper wire 63 will serve to close the circuit loop. In like manner, it will be appreciated that the jumper wire 62 would close the loop between the black and yellow conductors for the zone 58. It will be appreciated that, when the security circuit zones are arranged in series loops, as illustrated, the present invention permits three such zones.

In operation, when any of the door 52 or the windows 53 is opened, the associated reed switch 15 will open, thereby deenergizing the relay 33 of the modular alarm unit 30 and causing its contacts to close to actuate the alarm siren 38.

Referring now to FIG. 5, there is illustrated an alternative security circuit 70, which is also a series-connected circuit, but instead of being powered by a battery is adapted to be powered by a personal computer 71. More specifically, the personal computer 71 includes a serial input/output card 72, which typically has a 25-pin connector 73 and provides a standard RS-232 port in a well known manner. Such a serial port generates a standard array of signals which, although normally used for entirely different purposes in the personal computer 70, can be utilized for purposes of the present invention to power the security circuit 70. For this purpose, there is also provided an adapter 75, which may be a standard DB25-RJ adapter for providing interconnection between a 25-pin connector and a standard telephone jack plug. The adapter 75 has 25 pin holes, only selected ones of which are utilized with the present invention.

The security circuit 70 is otherwise similar to the security circuit 50 described above in connection with FIG. 4, for monitoring of a door 52 and a number of windows 53, all connected in series. However, the two zones, here designated 1 and 2, are all shown as connected in the same series string. Thus, the door 52 and the first and third windows 53 are in one zone and the second and fourth windows are in the other zone. Accordingly, the first zone includes modular switch units 10, having the switch connected to the red conductor, while the zone 2 elements utilize the modular switch unit 10A, with the switch connected to the black conductor. In this case, the modular alarm unit 30A of FIG. 6A is utilized, wherein all of the conductors are straight-wired through and the alarm circuitry is connected across the blue and white conductors. Accordingly, a terminator plug 60A will be utilized, which is substantially identical to the terminator plug 60 described in connection with FIGS. 7 and 8, except that the jumper wire 61 is omitted, since the circuit loop between the blue and white conductors is now closed by the modular alarm unit 30A.

In operation, the serial input/output card 72 generates continuous monitor signals on the red and black conductors. If the door 52 or one of the windows 53 is opened, the corresponding monitor signal is interrupted. This condition is recognized by the personal computer 71, which causes the card 72 to output a signal on the blue or white conductor to close the relay 33 of the alarm unit 30A to activate the alarm signal.

It will be appreciated that the configuration of FIG. 5, wherein two zones are included in a single series string, could also have been utilized in the circuit 50 of FIG. 4, requiring only the substitution of the modular alarm unit 30A and the terminator plug 60A, respectively, for the alarm unit 30 and the terminator plug 60.

Figure 9:
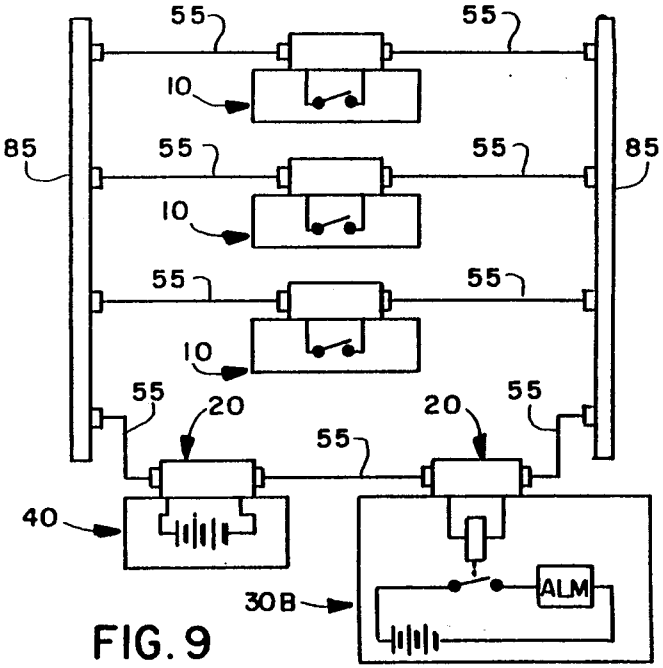
FIG. 9 is a schematic circuit diagram of another embodiment of security circuit in accordance with the present invention with the alarm sensing devices connected in parallel with each other.

Referring to FIG. 9, there is illustrated an alternative security circuit 80 which includes a plurality of the modular switch units 10 connected in parallel across the series combination of the modular battery unit 40 and a modular alarm unit 30B, all by means of connector cables 55. The modular switch units 10 would all be of the same color, e.g., red, as would the modular alarm unit 30B, except that the switch units 10 would now be connected in their normally-open configurations. The modular alarm unit 30B is substantially identical to the alarm unit 30, described above in connection with FIG. 6, except that the relay 33 is held open when deenergized. The parallel branches of the network may be connected at common nodes by means of commercially available telephone jack patch panels or distribution panels 85. It will be appreciated that, if any of the switch units 10 is closed, the relay of the modular alarm unit 30B will be energized, activating the alarm signal. Parallel circuit arrangements could also be powered by a personal computer 71, as in FIG. 5. In this case the serial port could be configured, by suitable software, to determine when any parallel switch branch is closed.

While a number of exemplary circuit configurations has been illustrated herein, these illustrations are merely exemplary, and it will be appreciated that the modular switch units 10A and 10B and the modular alarm units 30, 30A and 30B could be utilized in other security circuit configurations. Also, while the invention has been described with 6-conductor jacks, it will be appreciated that jacks with other numbers of conductors could also be used.

From the foregoing, it can be seen that there has been provided an improved modular security circuit and modular devices therefor which can be readily interconnected without the use of tools by simple, standard, telephone-type connector cables provided with standard telephone-type jack plugs.

I claim:

1. A modular device for interconnection with other devices by means of standard multiple conductor telephone connector cables each having ends terminated respectively by modular telephone jack plugs, said modular device comprising: an insulated housing including a function portion and a modular jack portion, a function circuit disposed in said function portion, and two standard telephone jack sockets disposed in said jack portion and each having a plurality of conductors, at least one conductor of one of said sockets and a corresponding at least one conductor of the other of said sockets being connected to said function circuit, the remaining conductors of said one socket being respectively directly connected to the corresponding conductors of said other socket.

2. The modular device of claim 1, wherein said function portion and said modular jack portion of said housing are interconnected discrete parts.

3. The modular device of claim 2, wherein said function portion is adhesively secured to said modular jack portion.

4. The modular device of claim 1, wherein each of said sockets includes six conductors.

5. The modular device of claim 1, wherein said function circuit is a power supply.

6. The modular device of claim 1, wherein said function circuit includes an alarm device.

7. The modular device of claim 6, wherein said function circuit is connected across two conductors of said sockets.

8. The modular device of claim 1, wherein said function circuit includes an alarm condition sensing device.

9. The modular device of claim 8, wherein said sensing device includes a switch.

10. The modular device of claim 9, wherein said switch is a reed switch and further comprises magnet means adapted to be disposed adjacent to said function portion of said housing for operation of said switch in response to relative movement of said function portion and said magnet means.

11. The modular device of claim 1, wherein said conductors are color coded.

12. The modular device of claim wherein said at least one of said conductors extend outside said housing so as to be visible to a user.

13. A security circuit comprising: a power supply including at least one standard modular telephone jack socket connected thereto and carried thereby, at least one modular sensing device including two standard telephone jack sockets connected thereto and carried thereby, a modular alarm device including two standard telephone jack sockets connected thereto and carried thereby, and a plurality of standard telephone connector cables each having ends terminated respectively by standard telephone jack plugs mateable with said sockets for interconnecting said power supply and said sensing device and said alarm device in circuit.

14. The security circuit of claim 13, wherein said power supply includes a battery.

15. The security circuit of claim 13, wherein said power supply includes a personal computer having a connector terminal, and further comprising adapter means for interconnecting said terminal with a jack plug of one of said cables.

16. The security circuit of claim 13, wherein said at least one sensing device includes a magnetically operated reed switch.

17. The security circuit of claim 13, and further comprising a terminator plug mateable with one of said sockets for terminating said circuit.

18. The security circuit of claim 13, wherein each of said sockets and each of said cables includes a like plurality of conductors, said circuit including plural zones each assigned to a different pair of said conductors, each zone having all of the sensing devices therein connected to its assigned pair of conductors.

19. The security circuit of claim 13, wherein said circuit includes plural modular sensing devices connected in series.

20. The security circuit of claim 13, wherein said circuit includes plural modular sensing devices connected in parallel.

* * * * *

UNITED STATES PATENT AND TRADEMARK OFFICE

CERTIFICATE OF CORRECTION

PATENT NO. : 5,254,973

DATED : October 19, 1993

INVENTOR(S) : John H. Gilmore, II

It is certified that error appears in the above-identified patent and that said Letters Patent is hereby corrected as shown below:

Claim 12, line 20, after "claim", insert --11,--.

Signed and Sealed this

Fifth Day of April, 1994

Bruce Lehman

*Attest:*

BRUCE LEHMAN

*Attesting Officer*

*Commissioner of Patents and Trademarks*